United States Patent [19]

Bartlett

[11] 3,964,266

[45] June 22, 1976

[54] BUOYANCY COMPENSATING BACK PACK ASSEMBLY

[76] Inventor: Ronald D. Bartlett, c/o Metropolitan Water District, Earp, Calif. 92242

[22] Filed: July 21, 1975

[21] Appl. No.: 597,347

[52] U.S. Cl. ..... 61/70; 9/319

[51] Int. Cl.[2] ..... B63C 11/22

[58] Field of Search ..... 61/69, 70; 9/314, 316, 9/319, 329, 342; 128/142–142.7

[56] References Cited

UNITED STATES PATENTS

| | | | |
|---|---|---|---|
| 3,379,023 | 4/1968 | Crose | 61/70 |
| 3,436,777 | 4/1969 | Greenwood | 9/342 |
| 3,747,140 | 7/1973 | Roberts | 9/319 |
| 3,820,348 | 6/1974 | Fast | 61/70 |

*Primary Examiner*—Paul R. Gilliam
*Assistant Examiner*—David H. Corbin
*Attorney, Agent, or Firm*—William C. Babcock

[57] ABSTRACT

A buoyancy compensating back pack assembly that permits a scuba diver wearing the assembly, together with a tank of pressurized air and associated breathing apparatus to attain and maintain a desired buoyancy while descending or ascending in the water, and regardless of his depth. The assembly permits a diver to achieve the above objectives without the use of a weight belt or an inflatable air vest. After the diving operation is completed, the assembly may be so arranged that such gear as fins, knife, and the like, can be disposed within the confines thereof for carrying purposes. During the diving operation one or more watertight pockets forming a part of the assembly may have dry wearing apparel stored therein for use after the diving operation is completed.

7 Claims, 13 Drawing Figures

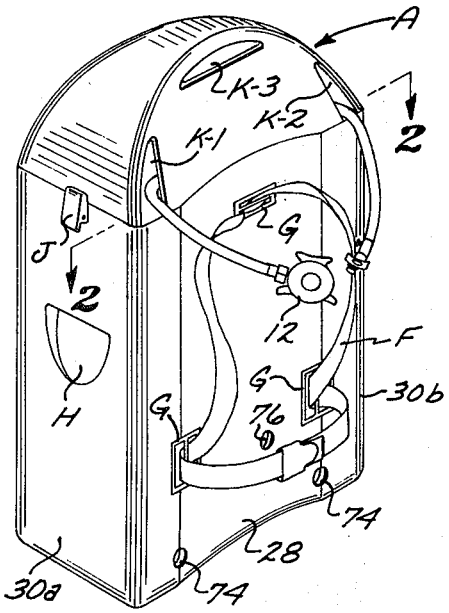
FIG. 1
FIG. 2
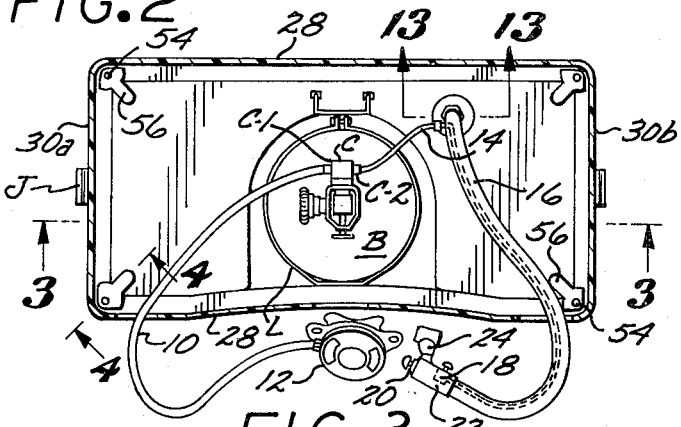
FIG. 3
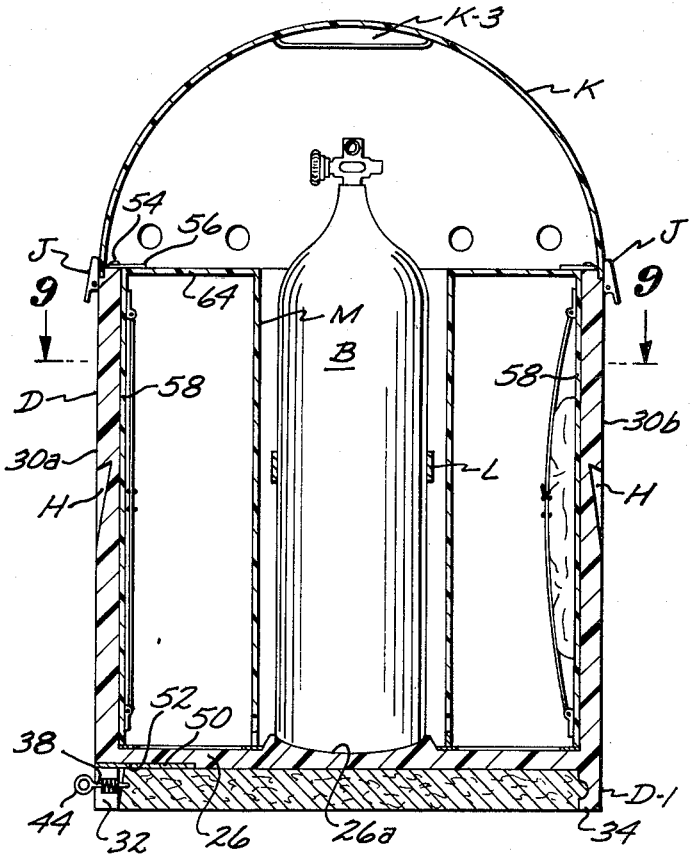
FIG. 4
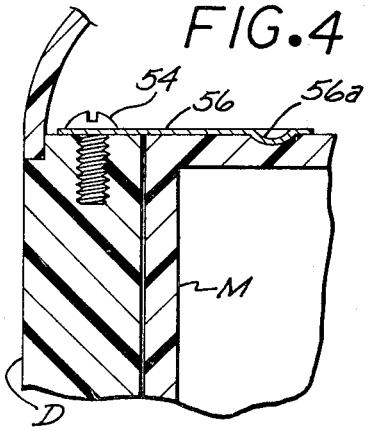
FIG. 5
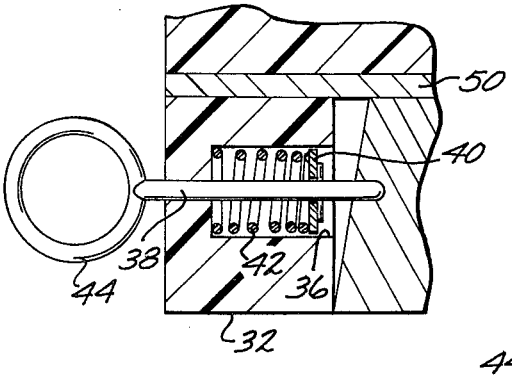
FIG. 6
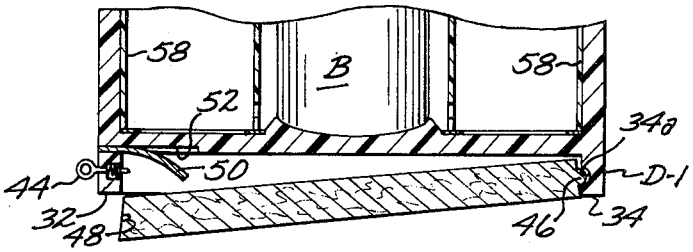

FIG. 7
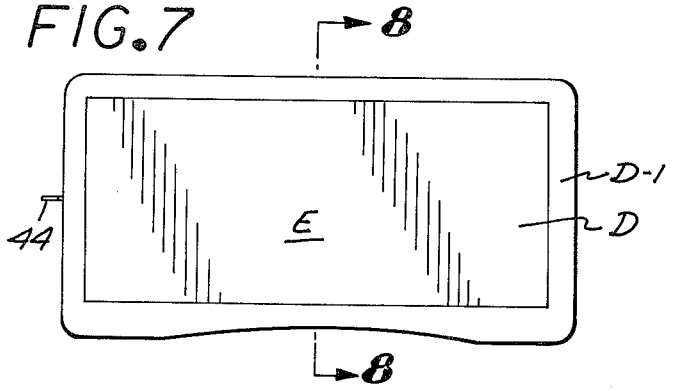
FIG. 8
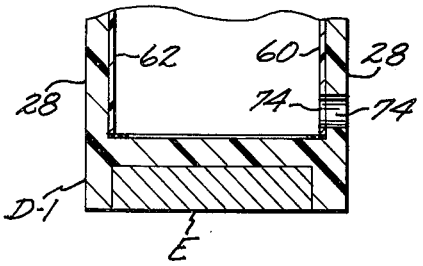
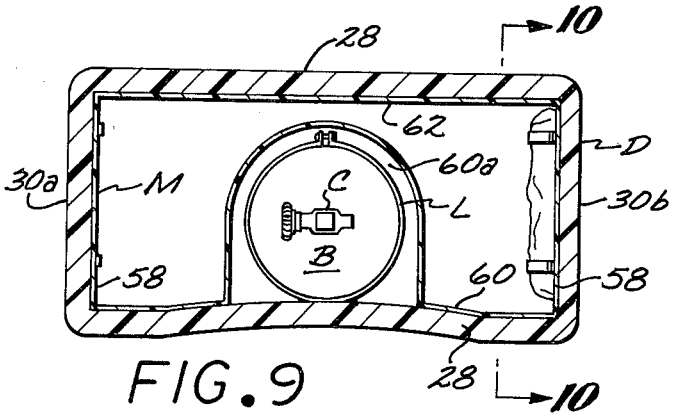
FIG. 9
FIG. 10
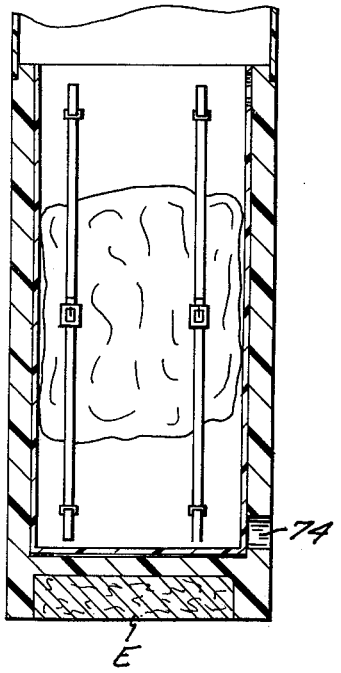
FIG. 11
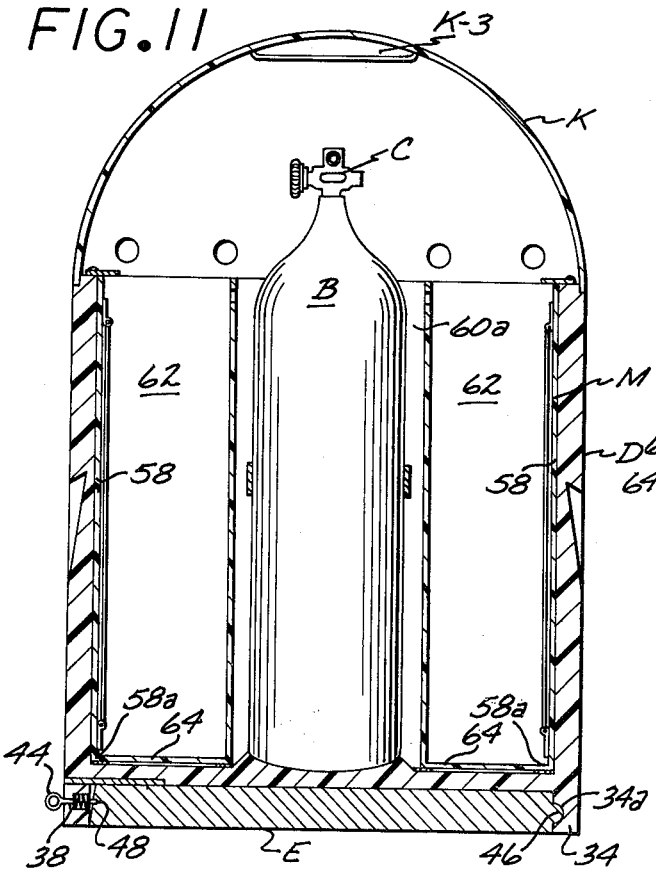
FIG. 12
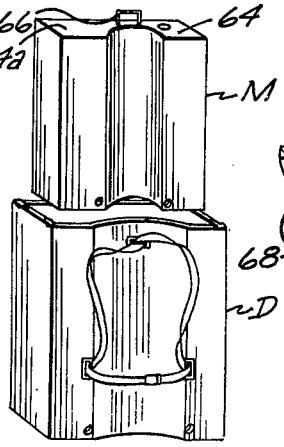
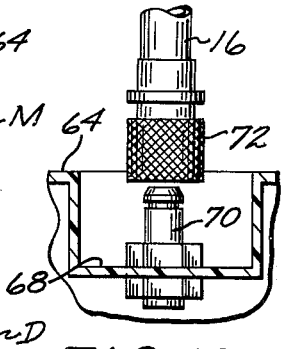
FIG. 13

BUOYANCY COMPENSATING BACK PACK ASSEMBLY

BACKGROUND OF THE INVENTION

1. Field of the Invention

Buoyancy Compensating Back Pack Assembly.

2. Description of the Prior Art

Various types of buoyancy regulating devices have been devised and used in the past. However, the operational disadvantages of such devices have been that they are unduly bulky and cumbersome, and are difficult for one person to carry when the person also must carry accessory equipment such as fins, knife and the like. Also, such prior art devices include no facilities for carrying wearing apparel in a dry condition for use after the diving operations are complete.

SUMMARY OF THE INVENTION

The buoyancy compensating back pack assembly is used in conjunction with at least one container for pressurized air, which container has a depth-actuated control valve mounted thereon that has first and second air outlets. The first outlet has a pliable hose extending therefrom to a first mouthpiece. The second outlet has a second pliable hose connected thereto that enters a third hose. Flow of air from the second hose into the third hose is controlled by a manually operated second valve, which second valve is normally closed. A first end of the third hose has a second mouthpiece mounted thereon. Communication between the second mouthpiece and the interior of the third hose is controlled by a second manually operated valve tht is normally closed. A second end of the third hose has a quick disconnect fitting mounted thereon.

The back pack assembly includes a first housing, open at the top, in which the container for pressurized air is disposed, with the first housing having a diver's harness removably secured thereto, and with the first housing on the bottom releasably supporting a weight that is preferably in the form of a slab. A second housing also open at the top, is inserted within the first housing in an inverted position, with the first and second housings cooperatively defining a confined space within the interiors thereof. The upper portion of the bottle and the depth responsive control valve mounted thereon are protected by a rigid dome removably secured to the upper open end of the first housing. When the second housing is so disposed, a transverse cross piece forming a part thereof serves as the top of the confined space. A tubular fitting is mounted on the transverse cross piece and has the quick disconnect fitting secured thereto.

The first and second housings adjacent the weight previously mentioned have axially aligned transverse openings therein that serve as passages for both air and water. The first housing has an opening therein through which water may flow freely to flood a compartment defined by the first and second housings in which the container for pressurized air is situated.

When the assembly is in the position above described, it is removably secured to the back of a diver by the harness. When the diver enters the water, water will flow into the confined space through the axially aligned openings to trap a body of air in the upper portion of this confined space. This trapped air will provide sufficient buoyancy that the diver will not sink.

To allow the diver to sink, the diver assumes a diving position until a portion of the trapped air escapes through the aligned openings. Air will be allowed to escape until the diver has negative buoyancy and is sinking. The diver then assumes a slightly upwardly directed position where the remaining trapped air will not escape from the confined space. The diver, after descending to a desired depth, may stabilize his position by adding sufficient air to the confined space that he has neutral buoyancy. The diver during his descent has been breathing air through the first mouthpiece. Additional air may be added to the confined space by the diver when he places the second mouthpiece in his mouth, opening the second valve, and exhaling into the third hose that is in communication with the confined space. The diver may also cause additional air to flow into the confined space by opening the first valve. When the diver desires to descend he may attain negative buoyancy by opening the second valve to allow air to escape from the confined space. The diver attains positive buoyancy and ascends when he adds additional air to that in the confined space either by breathing into the second mouthpiece or manipulating the first valve.

After a diver has completed a diving operation, the assembly is removed from his back, and the dome removed from the first housing. The position of the second housing is then reversed. The first and second housings then cooperate to provide a container in which gear such as fins, knife, and the like, may be disposed for carrying purposes. The dome may then be secured to the first housing to protect the upper portion of the container and the control valve mounted thereon. The first housing preferably has grips on opposite sides thereof that may be engaged by the hands of a diver when the assembly is being moved. The weight is preferably formed from concrete, and is so inexpensive that it may be separated from the assembly by a diver without considering the cost of the weight.

BRIEF DESCRIPTION OF THE DRAWINGS

FIG. 1 is a perspective view of the invention arranged for use as a diver's buoyancy compensating back pack assembly;

FIG. 2 is a transverse cross-sectional view of the assembly, taken on the line 2—2 of FIG. 1;

FIG. 3 is a longitudinal cross-sectional view of the assembly, taken on the line 4—4 of FIG. 2;

FIG. 5 is another fragmentary cross-sectional view of the assembly illustrating the release that holds the weight in place;

FIG. 6 is a fragmentary longitudinal cross-sectional view of the assembly illustrating the manner by which the weight may be released therefrom;

FIG. 7 is a bottom plan view of the assembly;

FIG. 8 is a fragmentary longitudinal cross-sectional view of the assembly, taken on the line 8—8 of FIG. 1;

FIG. 9 is a transverse cross-sectional view of the assembly, taken on the line 9—9 of FIG. 3;

FIG. 10 is a longitudinal cross-sectional view of the assembly, taken on the line 10—10 of FIG. 9;

FIG. 11 is a longitudinal cross-sectional view of the assembly when the latter is arranged to have a diver's gear stored within the confines thereof;

FIG. 12 is a perspective view of the assembly with the first and second housings separated from one another; and FIG. 13 is a fragmentary perspective view of the assembly, taken on the line 13—13 of FIG. 2.

DESCRIPTION OF THE PREFERRED EMBODIMENT

The buoyancy compensating back pack assembly A shown in FIG. 1 is adapted to be used by a diver (not shown) in conjunction with an elongate cylindrical tank B for pressurized air that has a depth-actuated control valve C mounted thereon. Valve C has first and second air outlets C-1 and C-2. A first pliable hose 10 extends from first outlet C-1 to a first diver's mouthpiece 12 of conventional design and is at present commercially available. A second pliable hose 14 is connected to second outlet C-2.

The second hose 14 is partially enveloped in a third pliable hose 16 and extends longitudinally through the latter to a second normally closed, manually operated first valve 18. A second mouthpiece 24 is mounted on a first end 22 of the third hose 16. Communication between the second mouthpiece 24 and interior of the third hose 16 is controlled by a manually operated second valve 20 that is normally closed.

The assembly A, as may best be seen in FIGS. 1–3, includes a first housing D of a desired transverse cross section. The first housing D is illustrated as being of substantially rectangular shape and defined by a bottom 26, a pair of side walls 28, and first and second end walls 30*a* and 30*b*.

The bottom 26 has a shallow rectangular frame D-1 that extends downwardly therefrom. Frame D-1 includes first and second end pieces 32 and 34. A weight E is provided that is illustrated in the drawing as being a slab of concrete that removably fits within the confines of frame D-1. The weight E serves the same function as a weight belt normally worn by a diver.

A cavity 36 is formed in first end piece 32 in which a pin 38 is longitudinally movable as shown in FIG. 5. Pin 38 supports a cross piece 40. A compressed helical spring 42 disposed in cavity 36 at all times tends to move pin 38 to the right, as viewed in FIG. 5. A handle 44 is provided on one end of pin 38 that acts as a stop to prevent spring 42 displacing pin 38 from cavity 36, and also provides means to permit the pin 38 to be moved to the left as seen in FIG. 5.

Weight E has a rib 46 formed on one end thereof that may removably engage a recess 34*a* formed in second end piece 34, as shown in FIG. 6. The opposite end of weight E has an opening 48 that is axially alignable with pin 38. When pin 38 engages opening 48, the weight E is removably held within the confines of frame D-1. Bottom 26 has a recess 52 formed in the lower surface thereof in which a resilient pad 50 is disposed that is pressure contacted by weight E when the weight is disposed in frame D-1 as shown in FIG. 3.

The side walls 28 and end walls 30*a* and 30*b* have upper edge surfaces that at their intersections have screws 54 extending downwardly therein, with each screw pivotally supporting a clip 56. Each clip 56 adjacent the free end thereof has a downwardly extending protuberance formed therein.

The first and second end walls 30*a* and 30*b* have hand-engageable grips H formed therein. One of the side walls 28 has a number of bar-defining fastening means G secured thereto which are removably engaged by a conventional diver's harness F. The upper exterior portions of end walls 30*a* and 30*b* support conventional manually operable fasteners J that removably engage a protective dome K. The dome K has oppositely disposed first and second openings K-1 and K-2 formed therein. A third opening K-3 is formed in the upper portion of dome K, as shown in FIG. 1.

The assembly A also includes a second housing M that is defined by a pair of end walls 58 and first and second side walls 60 and 62, which end walls and side walls have first end surfaces 58*a*, 60*a* and 62*a*. The second end surfaces of end walls 58 and side walls 60 and 62 are connected to a transverse cross piece 64.

Cross piece 64 has an exterior surface 64*a* from which a U-shaped handle 66 projects. The cross piece 64 has a recess 68 formed therein in which a tubular fitting 70 is disposed that is at all times in communicatin with the interior of the second housing M.

A fastening band L is secured to the interior of the side piece 28 that supports harness F. Fastening band L removably engages tank B and secures the latter in a fixed position to first housing D. First side wall 60 has an elongate recess 60*a* formed therein, as shown in FIG. 12, that extends around container B when the second housing M is disposed within the second housing D in the manner illustrated in FIGS. 2 and 3.

The second housing M is removably supported within first housing D by pivoting the clips 56 to the positions shown in FIG. 2. Third hose 16 has a quick disconnect fitting 72 on the free end thereof that permits the hose to be removably secured to fitting 70. The interior surfaces of end walls 58 preferably support water-tight plastic pockets 74 in which dry wearing apparel may be stored for use by a diver after the diving operation is complete. The first and second housings D and M when disposed as shown in FIG. 3, cooperate to define a confined space N.

The side wall 28 that supports harness F and first side wall 60 of second housing M have axially aligned pairs of first openings 74 formed therein that establish communication between confined space N and the exterior of the assembly A. A second opening 76 is formed in the side wall 28 that supports harness F, with this second opening establishing communication between the exterior of assembly A and the space D in recess 60*a*.

The second housing M is of such size that it slidably and sealingly engages the interior of first housing D, and may be disposed therein in either the first position shown in FIG. 3, or the second position illustrated in FIG. 11.

The use and operation of the assembly has been previously described in the summary thereof and need not be repeated.

I claim:

1. In combination with a container for pressurized air having a first end portion on which a depth-sensitive control valve is mounted that has first and second air outlets; a first pliable hose having first and second ends, said first end being connected to said first outlet; a first diver's mouthpiece connected to said second end of said first hose; a second pliable hose having first and second ends, said first end of said second hose being connected to said second outlet; a third pliable hose having first and second ends, said third hose having said second hose entering the interior thereof intermediate said first and second ends; a first manually operated valve for controlling the flow of air from said second end of said second hose into the interior of said third hose; a second diver's mouthpiece mounted on said second end of said third hose; a second manually operated valve that may be used to establish communication between said second mouthpiece and the interior of said third hose, said first and second valves being normally closed; a first tubular fitting on said first end of said third hose, a buoyancy compensating back pack assembly that in a first position that is removably securable to a diver to permit him to descend or ascend in a body of water by control of the air-water ratio in said assembly and said asembly when in a second position being portable and serving as a carrier for a diver's gear such as fins and the like, said assembly including:

a. first and second open-top housings, said first housing including a bottom, said second housing slidably and sealingly engaging the interior of said first housing, said second housing including a transverse cross piece, said second housing when disposed in an inverted first position in said first housing cooperating with the latter to define a confined space, said second housing when disposed in a second upright position in said first housing providing space in which a diver's gear may be stored, said first and second housings having first openings formed therein that are axially aligned when said second housing is in said first position;

b. first means for removably supporting said container in said first housing with said control valve disposed thereabove, with said second housing being of such shape that when in said first position it cooperates with said first housing to define a compartment in which said container is disposed, said first housing having a second opening therein that at all times maintains communication between said compartment and the exterior of said first housing;

c. a diver's harness secured to the exterior of said first housing;

d. second means for removably locking said second housing to said first housing in either said first or second positions;

e. a weight;

f. third means for releasably supporting said weight from said first housing; and g. a second tubular fitting on said cross piece that may be connected to said first fitting to establish communication between said third hose and confined space when said second housing is in said first position, with a diver wearing said assembly having positioned buoyancy when he first enters the water due to air trapped in said confined space, said assembly providing negative buoyancy to a diver when the diver assumes a diving position to allow at least a portion of said trapped air to escape through said aligned first openings, and said assembly after the diver has assumed at least a slightly upright position providing a desired buoyancy due to the air-water ratio in said confined space that is controlled either by the diver exhaling into said second mouthpiece with said second valve in an open position or opening said first valve to permit air to discharge from said third tube into said confined space, and said assembly serving as a carrier for diver's gear after a diving operation by disposing said second housing in said second position.

2. An assembly as defined in claim 1 in which said first means is a band secured to the interior of said first housing and that extends around said container to frictionally grip the latter and removably hold said container in said first housing.

3. An assembly as defined in claim 1 in which said second means are a plurality of spaced clips pivotally supported from the open top of said first housing, said clips when in a first position allowing said second housing to be moved into or out of said first housing, and said clips when in a second position extending over said second housing to removably hold said second housing in said first housing.

4. An assembly as defined in claim 1 in which said third means releasably support said weight from the exterior of said bottom of said first housing.

5. An assembly as defined in claim 4 in which said weight is generally rectangular in shape and formed from concrete.

6. An assembly as defined in claim 5 in which said third means includes a third frame that extends from said bottom of said first housing in which said weight is disposed.

7. An assembly as defined in claim 6 in which said frame includes first and second end pieces, said first end piece having a recess on the interior thereof, said weight having a protuberance thereon that removably engages said recess when said weight is disposed in said frame, a cavity formed in said weight opposite from said protuberance, and a spring loaded pin mounted in said second end piece that at all times tends to engage said cavity to hold said weight in said frame, but said pin capable of being manually moved out of engagement with said cavity to allow said weight to fall by gravity from said frame.

* * * * *